US011194291B2

(12) United States Patent
Kissling et al.

(10) Patent No.: US 11,194,291 B2
(45) Date of Patent: Dec. 7, 2021

(54) ACOUSTIC TIMEPIECE DISPLAY MECHANISM, PARTICULARLY A CHRONOGRAPH REPEATER

(71) Applicant: OMEGA SA, Biel/Bienne (CH)

(72) Inventors: Gregory Kissling, Macolin (CH); Julien Feyer, Vernier (CH)

(73) Assignee: OMEGA SA, Biel/Bienne (CH)

( * ) Notice: Subject to any disclaimer, the term of this patent is extended or adjusted under 35 U.S.C. 154(b) by 565 days.

(21) Appl. No.: 16/205,649

(22) Filed: Nov. 30, 2018

(65) Prior Publication Data

US 2019/0179266 A1 Jun. 13, 2019

(30) Foreign Application Priority Data

Dec. 11, 2017 (EP) ..... 17206439

(51) Int. Cl.
*G04B 21/12* (2006.01)
*G04B 21/00* (2006.01)
(Continued)

(52) U.S. Cl.
CPC ..... *G04B 21/12* (2013.01); *G04B 19/24* (2013.01); *G04B 21/00* (2013.01); *G04B 21/04* (2013.01);
(Continued)

(58) Field of Classification Search
CPC ..... G04B 21/00; G04B 21/005; G04B 21/02; G04B 21/04; G04B 21/06; G04B 21/08;
(Continued)

(56) References Cited

U.S. PATENT DOCUMENTS

2006/0133217 A1 6/2006 Schmiedchen
2012/0230161 A1* 9/2012 Goeller ..... G04F 3/022 368/244
2019/0187627 A1* 6/2019 Feyer ..... G04B 25/00

FOREIGN PATENT DOCUMENTS

CH 15 452 5/1898
CH 704 708 A2 9/2012
(Continued)

OTHER PUBLICATIONS

Response to the Chinese Office Action dated Jun. 22, 2020 in Chinese Patent Application No. 201811503681.8, 14 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece display mechanism includes a rotating display member for displaying a magnitude other than the current time of day, or a position in a cycle. The rotating display member is integral in rotation with a snail cooperating with the beak of a striking rack included in a striking mechanism integrated in or juxtaposed with this display mechanism, to strike a numerical value characteristic of this magnitude, or respectively of this position. The display mechanism is more particularly a chronograph mechanism including a seconds snail integral with a main chronograph wheel, for counting the seconds and cooperating with a seconds rack, and a minute snail integral with a minute counter wheel for counting the minutes and cooperating with a minute rack, in order, after timing a duration, to strike the minutes and seconds of the timed duration.

17 Claims, 3 Drawing Sheets

(51) Int. Cl.

| | |
|---|---|
| ***G04F 7/08*** | (2006.01) |
| ***G04B 21/04*** | (2006.01) |
| ***G04F 7/00*** | (2006.01) |
| ***G04B 19/24*** | (2006.01) |
| ***G04B 25/00*** | (2006.01) |
| *G04B 19/26* | (2006.01) |

(52) U.S. Cl.
CPC ..... *G04B 25/00* (2013.01); *G04F 7/00* (2013.01); *G04F 7/08* (2013.01); *G04F 7/089* (2013.01); *G04B 19/268* (2013.01)

(58) Field of Classification Search
CPC ..... G04B 21/12; G04B 19/268; G04F 7/00; G04F 7/08; G04F 7/089
See application file for complete search history.

(56) References Cited

FOREIGN PATENT DOCUMENTS

| | | | |
|---|---|---|---|
| CH | 704 708 | B1 | 9/2012 |
| EP | 1 672 442 | A1 | 6/2006 |
| EP | 1 672 442 | B1 | 6/2006 |
| FR | 2 919 398 | A1 | 1/2009 |
| FR | 2 919 398 | B1 | 1/2009 |

OTHER PUBLICATIONS

European Search Report dated Jun. 22, 2018 in European Application 17206439.6 filed on Dec. 11, 2017 (with English Translation of Categories of Cited Documents).

* cited by examiner

ACOUSTIC TIMEPIECE DISPLAY MECHANISM, PARTICULARLY A CHRONOGRAPH REPEATER

CROSS-REFERENCE TO RELATED APPLICATION

This application claims priority to European Patent Application No. 17206439.6 filed on Dec. 11, 2017, the entire disclosure of which is hereby incorporated herein by reference.

FIELD OF THE INVENTION

The invention concerns a timepiece display mechanism comprising at least one rotating display member, for displaying a magnitude other than the current time of day, or respectively for displaying a position in a cycle, which display mechanism is an acoustic display mechanism, wherein said rotating display member is integral at least in rotation with a snail whose edge cooperates with the feeler arm of a striking rack comprised in a striking mechanism integrated in or juxtaposed with said display mechanism, to chime a numerical value characteristic of said magnitude, or respectively of said position in said cycle.

The invention also concerns a timepiece, especially a watch, including at least one such display mechanism.

The invention concerns the field of timepiece display mechanisms.

BACKGROUND OF THE INVENTION

Some timepiece displays are sometimes difficult to read, in particular when the timepiece is a watch of small dimensions, such as a ladies watch, or even a complicated watch, comprising a large number of displays, each then necessarily occupying a restricted surface area, or being superposed on other displays, which can make interpretation imprecise for the user, which is paradoxical when it comes to a precision time measurement.

The reading of a display can also be hampered by low ambient lighting, such as during diving, or at certain times at night or dusk, or may conversely be hampered by interfering light that creates shadows making the indications illegible, or because of the user's visual impairment or particular conditions of employment, such as night flying or certain specific operations. This is why, moreover, horologists in the XVIII and XIX centuries developed striking, passing strike or repeater watches, or tactile watches providing tactile information.

French Patent No FR2919398B1 in the name of PATEK PHILIPPE thus discloses a repeater, strike on demand or passing strike mechanism for a timepiece, which strikes automatically or on demand at least the tens and the units of the date in a current month, and/or the current month, and/or the day of the week, and which includes a tens rack that replaces the usual quarter rack in a minute repeater mechanism.

SUMMARY OF THE INVENTION

The invention proposes to combine a traditional visual display with an acoustic display, or to replace a traditional visual display with an acoustic display, and, to this end, concerns a timepiece display mechanism according to claim 1.

This display mechanism is more particularly a chronograph mechanism comprising a seconds snail integral with a main chronograph wheel, for counting the seconds and cooperating with a seconds rack, and a minute snail integral with a minute counter wheel set for counting the minutes and cooperating with a minute rack, in order, after timing a duration, to strike the minutes and seconds of the timed duration.

The invention also concerns a timepiece, especially a watch, including at least one such display mechanism.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
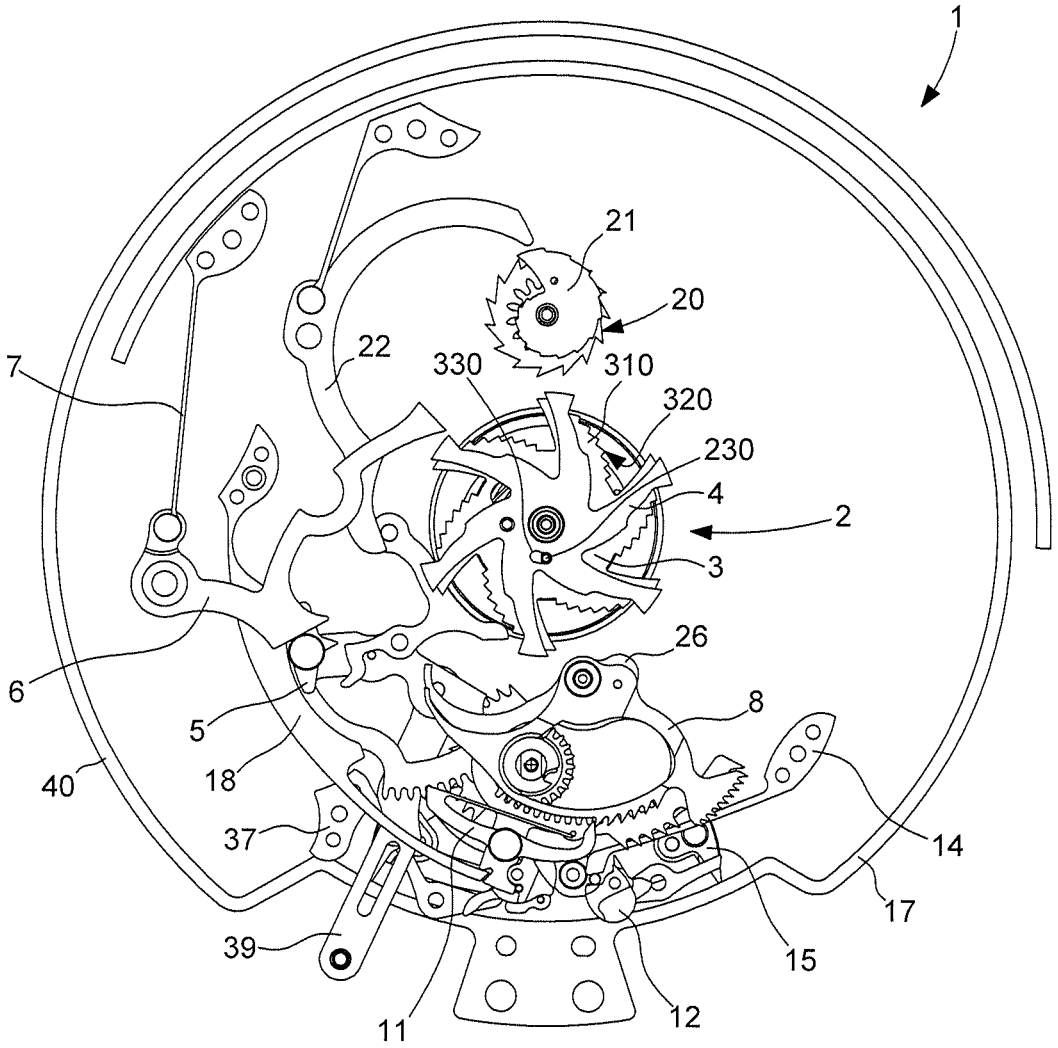
FIG. 1 represents a schematic, plan view of a first level of a display mechanism according to the invention, which is a chronograph mechanism, comprising at least one main chronograph wheel for counting the seconds, and a minute counter wheel for counting down the minutes, each provided with a snail which cooperates with a striking rack, respectively a seconds rack and minute rack, of an on demand striking mechanism, similar to a minute repeater mechanism.

The invention concerns a timepiece display mechanism 500 for a timepiece 1000, especially a watch, or a clock.

This timepiece 1000 includes, in a conventional manner, a movement, and energy storage means, for at least driving an oscillator, which are not described in detail here. This timepiece 1000 may also consist of a music box.

This display mechanism 500 comprising at least one rotating display member, such as a hand, disc or suchlike, for displaying a magnitude other than the current time of day, or respectively for the cyclical display of a position in a cycle.

A 'magnitude other than the current time of day' means a magnitude such as a time duration for a chronograph mechanism, or a total number of actions on a pusher for a sports referee device, or suchlike.

The 'display of a position in a cycle' means a display whose value periodically returns over time, such as a day/night display, an AM/PM (morning/afternoon) display, a spring/summer/autumn/winter display, a new moon/first quarter/full moon/last quarter moon phase display, a tide display, a day of the week display, a month of the year display, a date display, or suchlike.

This display mechanism 500 is or includes an acoustic display mechanism. To this end, the rotating display member is integral, at least in rotation, with a snail whose edge cooperates with the beak of a striking rack comprised in a striking mechanism 1, which is integrated in or juxtaposed with display mechanism 500, for striking a numerical value characteristic of the magnitude, or respectively of the position in the cycle.

The invention is more particularly described, in a non-limiting manner, for an on-demand display, by user action on a control member, such as a pusher, bolt, crown, bezel or any other actuator.

Naturally, the invention can also be implemented with an automatic release device. For example, in the particular case of a chronograph mechanism set out below, the stop pusher of the chronograph mechanism can be used to start a timing function, particularly of adjustable duration, at the end of which the timepiece movement can cause a reading to be taken, in a similar manner to a passing strike, by sending each striking rack to read the corresponding snail.

According to the invention in the particular and non-limiting application illustrated by the Figures, this display mechanism 500 is a chronograph mechanism 100, which includes at least a centre chronograph wheel 2 for counting the seconds, and a minute-counter wheel 20 for counting the minutes.

This chronograph mechanism 100 according to the invention includes at least a seconds snail 3 integral in rotation with centre chronograph wheel 2 and whose edge is arranged to cooperate with a beak comprised in a seconds rack 8. It also includes at least one minute snail 21 integral in rotation with minute counter wheel 20, and whose edge is arranged to cooperate with a beak comprised in minute rack 22. Minute rack 22 and seconds rack 8 are arranged to provide, after stopping at the end of a measurement of a timed duration made by chronograph mechanism 100, information relating to the timed duration, respectively in minutes and seconds, to a striking mechanism 1 comprised in chronograph mechanism 100 or with which chronograph mechanism 100 is juxtaposed, in order to strike at least the minutes and the seconds of the timed duration. This striking mechanism 1 comprises seconds rack 8 and minute rack 22, for striking at least the minutes and the seconds of the timed duration.

Chronograph mechanism 100 thus forms, in combination with striking mechanism 1, a chronograph repeater mechanism.

More particularly, chronograph mechanism 100 also includes an intermediate duration cam, integral in rotation with seconds snail 3 and centre chronograph wheel 2, and including shoulders 240 having an equal duration which is an integer sub-multiple of a minute, and whose edge is arranged to cooperate with a beak comprised in an intermediate duration rack comprised in striking mechanism 1, to strike the minutes, the intermediate durations and the seconds of the timed duration. This intermediate duration cam forms a snail, each shoulder 240 of which corresponds to a different radius value from the others. More particularly, and as illustrated by the Figures, the intermediate duration cam is a tens cam 24, including six shoulders 240 and arranged to count the tens of seconds, and the corresponding intermediate duration rack is a tens rack 26. Naturally, other divisions can be envisaged, particularly a cam for the thirties, twenties, fifteens, dozens or otherwise. Tens cam 24 is easier for the user to interpret, and the number of divisions of seconds snail 3 which is associated therewith, which has six arms 310 here, each with ten notches 320, and which corresponds to the last striking function carried out, is sufficiently reduced in size to be visible to the user.

In a particular embodiment, striking mechanism 1 is an additional module, which includes a striking plate, which includes complementary indexing means which are arranged to cooperate with indexing means comprised in chronograph mechanism 100.

More particularly, chronograph mechanism 100 is an additional module, which includes a chronograph plate, which includes complementary, main indexing means arranged to cooperate with main indexing means comprised in a timepiece 100.

In the particular embodiment illustrated, striking mechanism 1 includes a minute beak 22, which is arranged to cooperate, on the one hand, in a reading arrangement with minute snail 1, and on the other hand with a gathering rack 33 meshing with a gathering rack pinion 31 integral in rotation with a minute ratchet 32 for driving a minute hammer trip 34, to drive a first hammer 35.

Striking mechanism 1 includes a tens rack 26, which is arranged to cooperate, on the one hand, in a reading arrangement with a tens cam 24, integral in rotation with centre chronograph wheel 2, and on the other hand with a first tens hammer trip 30, for driving first hammer 35, or more conventionally a second hammer 13, and with a second tens hammer trip 29 for respectively driving a second hammer 13 or more conventionally first hammer 35.

Striking mechanism 1 also includes a seconds rack 8, which is arranged to cooperate, on the one hand in a reading arrangement with seconds snail 3, and on the other hand with a seconds hammer trip 12 for driving said second hammer 13, or a third hammer. Indeed, the invention is illustrated with a simplified system including only a first gong 40, of deeper pitch than a second gong 17, and only a first hammer 35 and a second hammer 16. Of course, it is possible to use a striking mechanism 1 with more gongs, and for the tone corresponding to each striking rack to be completely different.

In short, this chronograph mechanism 100, also called a "chrono chime", includes a striking mechanism 1 with an identical arrangement to that of a quarterminute-repeater mechanism, where the hours are replaced by the minutes, the quarters are replaced by the tens of seconds, and the minutes are replaced by the seconds. Those skilled in the art will have no difficulty in transposing the traditional arrangement of a minute repeater to the invention. Reference can be made to the work by Francois LECOULTRE entitled 'Les montres compliquees' (A Guide to Complicated Watches) 1985, ISBN 2-88175-000-1, which explains, in detail, the basic mechanisms forming striking mechanisms, at pages 97 to 205, in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition of such mechanisms in this universal reference work, in particular in the aforementioned last two chapters.

More specifically, striking mechanism 1 includes an winding lever 39, which is arranged to start the reading of this timed duration on the snails and cams, and to drive gathering rack 33 against elastic return means forming the acoustic display drive means to move, on the one hand a gathering rack pinion 31 integral with minute ratchet 32 for striking the elapsed minutes, and on the other hand, tens rack 26, then seconds rack 8 for striking the tens of seconds then the elapsed seconds, with an identical arrangement to that of a quarter minute-repeater mechanism where the hours are replaced by the minutes, the quarters are replaced by the tens of seconds, and the minutes are replaced by the seconds. In particular, the coupling of tens rack 26 and seconds rack 8 is similar to that of a quarter minute-repeater.

More particularly, seconds snail 3 includes identical arms 310 including notches 320, each arm 31 corresponding to an intermediate duration which is an integer sub-multiple of a minute. Striking mechanism 1 includes a surprise-piece 4, which is arranged to temporarily extend the end of each arm 31 of seconds snail 3, to avoid erroneous indications at each change of intermediate duration.

More particularly, the intermediate duration of each arm 31 of seconds snail 3 is the same as that of shoulders 240 of the intermediate duration cam.

More particularly, surprise-piece 4 and the intermediate duration cam each include an oblong groove 330, respectively 241, cooperating with a pin 230 comprised in seconds snail 3.

Figure 2:
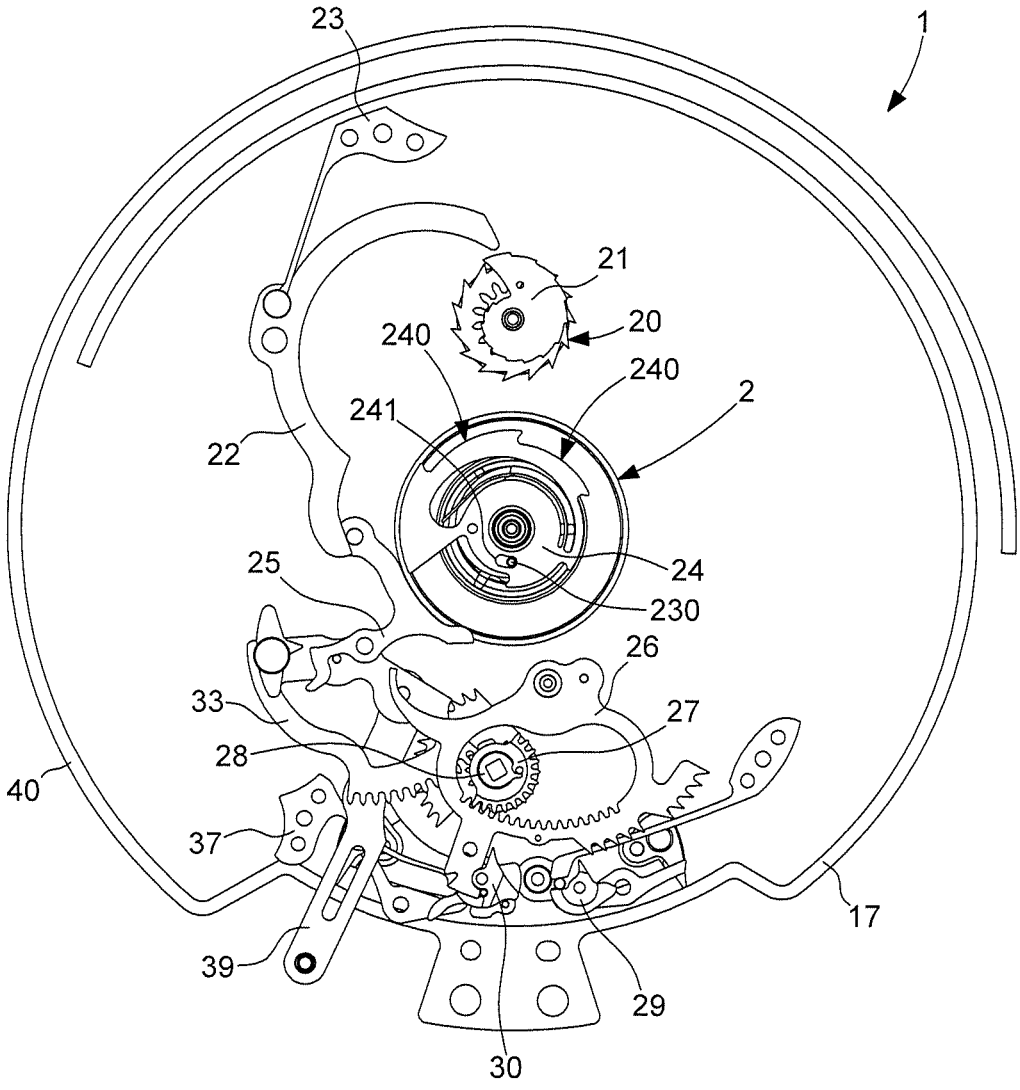
FIG. 2 represents, in a similar manner to FIG. 1, a second level which shows a tens cam coaxial with the main chronograph wheel, which cooperates with a tens rack.
Figure 3:
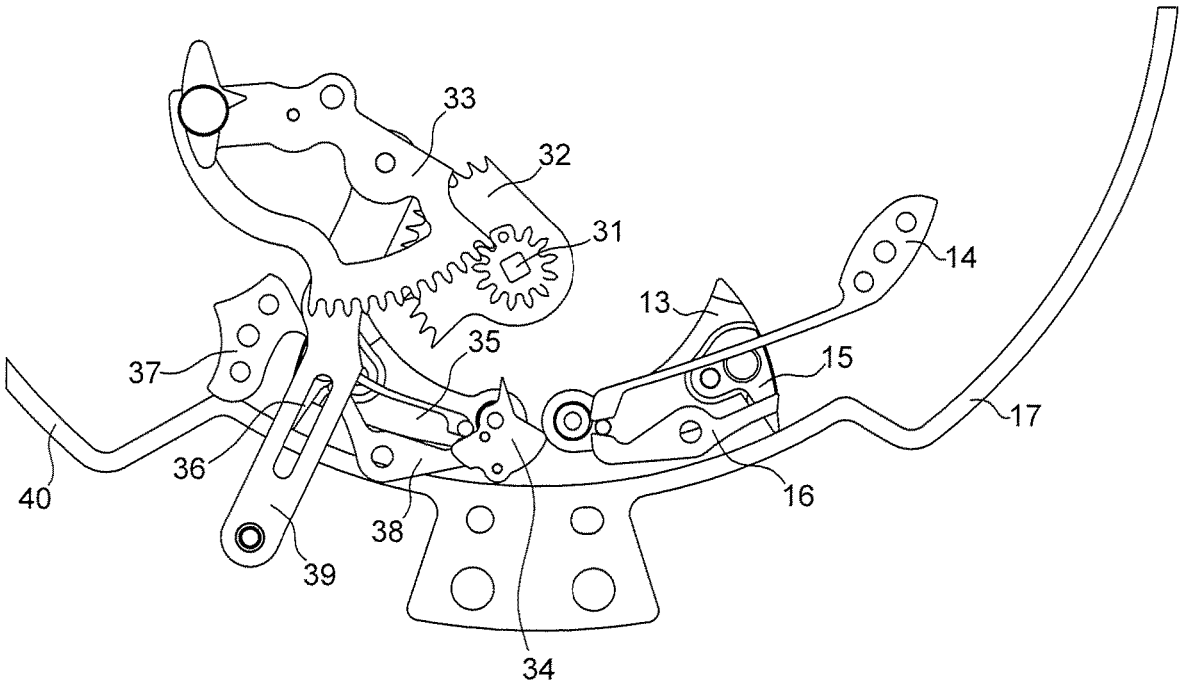
FIG. 3 represents, in a similar manner to FIG. 1, a detail of the control member of this striking mechanism, driving a gathering rack, then a gathering rack pinion, then the various striking racks for pivoting the various trips actuating the hammer trips for striking the gongs.
Figure 4:
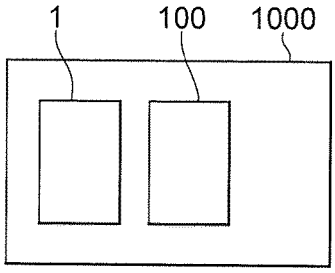
FIG. 4 is a block diagram representing a timepiece, especially a watch, wherein the striking mechanism is distinct from the display mechanism.
Figure 5:
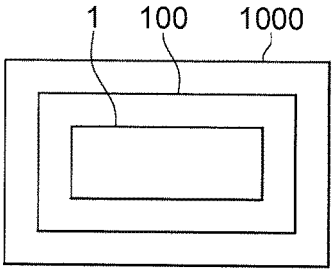
FIG. 5 is a block diagram representing a timepiece, especially a watch, wherein the striking mechanism is integrated in the display mechanism.

FIGS. 1 to 3 show the main constituent components of the striking mechanism:

- Actuating member 39, gathering rack 22, the striking unit with gathering rack pinion 31 and minute ratchet 32, release lever 5, all-or-nothing spring 18, rack arm 24, minute beak 22 with its minute beak spring 23, minute snail 21 and minute counter wheel 20;
- at the centre: main chronograph wheel 2, seconds snail 3, tens cam 24, and surprise-piece 4;
- a surprise piece jumper 6 and its surprise piece spring 7;
- tens drive finger 28 and tens rack pinion 27 in the striking unit, tens rack 26 and seconds click 11;
- seconds rack 8;
- minute hammer trip 34, first hammer 35, the striking portion of first hammer 35, first hammer spring 37, first hammer counterspring 38;
- The first tens hammer trip 30 acting on first hammer 35, and second tens hammer trip 29 acting on second hammer 13;
- Seconds hammer trip 12, second hammer 13, second hammer striking portion 15, second hammer spring 14, second hammer counterspring 16.

In a particular embodiment, chronograph mechanism 100 includes a rattrapante or split-seconds mechanism, whose display member is integral in rotation with a split-seconds snail whose edge cooperates with the beak of a split-seconds rack comprised in striking mechanism 1. It is possible to envisage having two striking mechanisms: one for the chronograph and a second for the split-seconds function, however this embodiment is cumbersome and substantially increases the thickness of a watch. Another more complex embodiment consists in using a single striking mechanism, which strikes on demand either the chronograph or the split-seconds function. In a simplified embodiment which conforms to almost all split-seconds mechanisms, the duration measured by the split time counter is limited to 60 seconds, which avoids having to count the minutes.

In another embodiment not illustrated by the Figures, display mechanism 500 includes a rotating display member arranged for the display of a position within a cycle, which is a day/night display, or an AM/PM display, or a spring/summer/autumn/winter display, or a new moon/first quarter/full moon/last quarter display.

More particularly, the rotating display member is arranged for the display of a position within a cycle, which is a date display, by striking the tens and units, or a day of the week display.

The invention can implement a more complex striking mechanism than those illustrated by the Figures, particularly with several striking functions or melodies as in the Patent Applications in the name of BLANCPAIN: traditional striking or melody playing function, striking mechanism with several stages with different rack components.

The invention also concerns a timepiece 1000, particularly a watch, including such a display mechanism 500.

In one embodiment, striking mechanism 1 is distinct from display mechanism 500.

In one embodiment, striking mechanism 1 is integrated in said display mechanism 500.

Although the acoustic display mechanism described above is designed to be combined with a conventional visual display, it can also replace the latter.

Through a limited transformation, consisting in adding snails to the display wheels concerned in existing calibres, the invention makes it possible to provide a timepiece, especially a watch, with new functionalities, and in particular by using existing striking mechanisms, adapted to the specific case by employing particular striking racks.

The invention claimed is:

1. A timepiece display mechanism comprising at least one rotating display member, for displaying a magnitude other than the current time of day, or respectively for displaying a position in a cycle, wherein said display mechanism is an acoustic display mechanism, whose rotating display member is integral at least in rotation with a snail whose edge cooperates with the beak of a striking rack comprised in a striking mechanism integrated in or juxtaposed with said display mechanism, for striking a numerical value characteristic of said magnitude, or respectively of said position in said cycle, wherein said display mechanism is a chronograph mechanism including a centre chronograph wheel for counting the seconds, and a minute-counter wheel for counting the minutes, and wherein said chronograph mechanism comprises at least a seconds snail integral in rotation with said centre chronograph wheel and whose edge is arranged to cooperate with a beak comprised in a seconds rack, and comprises at least one minute snail integral in rotation with said minute counter wheel and whose edge is arranged to cooperate with a beak comprised in a minute rack, and wherein said minute rack and said seconds rack are arranged to provide, after stopping at the end of a measurement of a timed duration made by said chronograph mechanism, information relating to the timed duration, respectively in minutes and seconds, to a striking mechanism comprised in said chronograph mechanism or with which said chronograph mechanism is juxtaposed, and which includes said seconds rack and said minute rack, in order to strike at least the minutes and the seconds of said timed duration.

2. The display mechanism according to claim 1, wherein said chronograph mechanism also comprises an intermediate duration cam integral in rotation with said seconds snail and with said centre chronograph wheel comprising shoulders having an equal duration which is an integer sub-multiple of a minute, and whose edge is arranged to cooperate with a beak comprised in an intermediate duration rack comprised in said striking mechanism, to strike the minutes, said intermediate durations and the seconds of said timed duration.

3. The display mechanism according to claim 2, wherein said intermediate duration cam is a tens cam arranged to count the tens of seconds, and wherein said intermediate duration rack is a tens rack.

4. The display mechanism according to claim 2, wherein said seconds snail has identical arms comprising notches, each said arm corresponding to an intermediate duration which is an integer sub-multiple of a minute, and wherein said striking mechanism includes a surprise-piece arranged to temporarily extend the end of each said arm of said seconds snail, to avoid erroneous indications at each change of intermediate duration, and wherein said intermediate duration of each said arm of said seconds snail is the same as that of said shoulders of said intermediate duration cam.

5. The display mechanism according to claim 2, wherein said seconds snail has identical arms comprising notches, each said arm corresponding to an intermediate duration which is an integer sub-multiple of a minute, and wherein said striking mechanism includes a surprise-piece arranged to temporarily extend the end of each said arm of said seconds snail, to avoid erroneous indications at each change of intermediate duration, and wherein said surprise-piece and said intermediate duration cam each include an oblong groove cooperating with a pin comprised in said seconds snail.

6. The display mechanism according to claim 1, wherein said striking mechanism is an additional module comprising a striking plate, which includes complementary indexing means arranged to cooperate with indexing means comprised in said chronograph mechanism.

7. The display mechanism according to claim 1, wherein said chronograph mechanism is an additional module comprising a chronograph plate, which includes complementary, main indexing means arranged to cooperate with main indexing means comprised in a timepiece.

8. The display mechanism according to claim 1, wherein said striking mechanism comprises said minute beak arranged to cooperate in a reading arrangement with said minute snail, and with a gathering rack meshing with a gathering rack pinion integral in rotation with a minute ratchet to drive a minute hammer trip to drive a first hammer, a tens rack arranged to cooperate in a reading arrangement with a tens cam integral in rotation with said centre chronograph wheel, and with a first tens hammer trip for driving said first hammer or a second hammer and with a second tens hammer trip for driving respectively a second hammer or said first hammer, and also includes said seconds rack arranged to cooperate in a reading arrangement with said seconds snail, and with a seconds hammer trip for driving said second hammer or a third hammer.

9. The display mechanism according to claim 8, wherein said striking mechanism comprises an actuating member arranged to cause a reading to be taken of said timed duration on the snails and cams and to drive said gathering rack against elastic return means forming the acoustic display drive means in order to move, a gathering rack pinion integral with said minute ratchet for striking the elapsed minutes, and said tens rack then said seconds rack for striking the tens of seconds then the elapsed seconds, with an identical arrangement to that of a quarter minute-repeater mechanism where the hours are replaced by the minutes, the quarters are replaced by the tens of seconds, and the minutes are replaced by the seconds.

10. The display mechanism according to claim 1, wherein said seconds snail has identical arms comprising notches, each said arm corresponding to an intermediate duration which is an integer sub-multiple of a minute, and wherein said striking mechanism includes a surprise-piece arranged to temporarily extend the end of each said arm of said seconds snail, to avoid erroneous indications at each change of said intermediate duration.

11. The display mechanism according to claim 1, wherein said chronograph mechanism comprises a rattrapante or split-seconds mechanism, whose display member is integral in rotation with a split-seconds snail whose edge cooperates with the beak of a split-seconds rack comprised in said striking mechanism.

12. The display mechanism according to claim 1, wherein said rotating display member is arranged for the display of a position in a cycle, which is a day/night display, or an AM/PM display, or a spring/summer/autumn/winter display, or a new moon/first quarter/full moon/last quarter display.

13. The display mechanism according to claim 1, wherein said rotating display member is arranged for the display of a position within a cycle, which is a date display, by striking the tens and units, or a day of the week display.

14. A timepiece comprising the display mechanism according to claim 1.

15. The timepiece according to claim 14, wherein said striking mechanism is distinct from said display mechanism.

16. The timepiece according to claim 14, wherein said striking mechanism is integrated in said display mechanism.

17. The timepiece according to claim 14, wherein said timepiece is a watch.

* * * * *